United States Patent [19]

Yamahata et al.

[11] Patent Number: 5,043,228

[45] Date of Patent: Aug. 27, 1991

[54] HEAT-SENSITIVE TRANSFERRING MEDIUM OF DELAYED SENDING TYPE

[75] Inventors: Takashi Yamahata, Koriyama; Tadatoshi Ohtsu, Hirakata, both of Japan

[73] Assignee: General Company Limited, Osaka, Japan

[21] Appl. No.: 400,381

[22] Filed: Aug. 30, 1989

Related U.S. Application Data

[60] Division of Ser. No. 945,804, Dec. 24, 1986, Pat. No. 4,948,446, which is a continuation of Ser. No. 702,079, Feb. 15, 1985, abandoned.

[30] Foreign Application Priority Data

Feb. 24, 1984 [JP] Japan ..... 59-33857

[51] Int. Cl.[5] ..... B41M 5/26

[52] U.S. Cl. ..... 428/484; 428/195; 428/488.4; 428/500; 428/521; 428/522; 428/913; 428/914

[58] Field of Search ..... 428/195, 207, 484, 488.1, 428/488.4, 913, 521, 522, 914

[56] References Cited

U.S. PATENT DOCUMENTS

| | | | |
|---|---|---|---|
| 4,231,667 | 11/1980 | Behrendt et al. | 400/208 |
| 4,353,658 | 10/1982 | Craft | 400/208 |
| 4,615,932 | 10/1986 | Onishi et al. | 428/195 |
| 4,617,224 | 10/1986 | Hotta et al. | 428/488.1 |

FOREIGN PATENT DOCUMENTS

| | | | |
|---|---|---|---|
| 1419804 | 12/1975 | United Kingdom | 428/195 |

OTHER PUBLICATIONS

Patents Abstracts of Japan, vol. 7, No. 203 (M-241)[1348], 8 Sep. 1983; & JP-A-58 101 095 (Fuji Kagaku Shikougiyou K.K.) 16-06-1983.

Patents Abstracts of Japan, vol. 4, No. 33 (M-3)[515], 21 Mar. 1980; & JP-A-557 467 (Tokyo Shibaura Denki K.K.) 19-01-1980.

*Primary Examiner*—Pamela R. Schwartz

*Attorney, Agent, or Firm*—Wegner, Cantor, Mueller & Player

[57] ABSTRACT

A heat-sensitive transferring medium of a delayed sending type comprises a heat-melting ink layer and an overcoating layer overlying said ink layer and mainly composed of resin and/or wax.

6 Claims, No Drawings

HEAT-SENSITIVE TRANSFERRING MEDIUM OF DELAYED SENDING TYPE

This application is a divisional of Ser. No. 945,804, filed Dec. 24, 1986, now U.S. Pat. No. 4,948,446 which is a continuation of Ser. No. 702,079, filed Feb. 15, 1985 now abandoned.

BACKGROUND OF THE INVENTION

1. Field of the Invention

This invention relates to a heat-sensitive transferring medium of delayed sending type.

2. Description of the Prior Art

Heat-sensitive transferring recording medium has been recently used widely in place of heat-sensitive color developing paper for the purpose of improving storing durability of recording.

The heat-sensitive transferring recording medium is such that heat is applied to the surface of the medium by means of a thermal head so as to melt the heat-melting ink in the heat-melting ink layer and transfer the molten ink to a receiving paper overlying the medium. The once-used ink sheet is not used again, in usual, and in addition, the heat-sensitive transferring recording mediums are expensive, and thereby, the running cost is disadvantageously high.

A proposed improvement is that a substrate of the heat-sensitive transferring recording medium is made in a form of an endless belt and the depleted heat-melting ink due to use is supplemented by coating with a heat-melting ink, but such ink-supplementing device built-in the recording apparatus results in enlarging the recording apparatus, and therefore, the apparatus itself becomes expensive though the running cost is inexpensive.

Another proposed improvement is to employ a heat-melting ink layer composed of a porous layer impregnated with a heat-melting ink. Such heat-melting ink layer can be repeatedly used so that the layer is usually called "multi-type". However, after used once, the heat-sensitive transferring recording medium having the multi-type layer should be rewound and a mechanism for rewinding s necessary.

The present inventors have found that the heat-sensitive transferring recording can be carried out even when the sending speeds of the heat-sensitive transferring medium and the receiving paper (a paper receiving the transferred ink for recording) are not the same (i.e. not the speed ratio of 1:1), but the sending speed of the heat-sensitive transferring medium is slower than that of the receiving paper.

The sending speeds of them can be easily made different by, for example, adding one gear to a conventional winding-up mechanism for heat-sensitive transferring mediums, or changing the number of tooth of gear even without changing the production line of the apparatus, and therefore, the advantage is very large from the stand-points of the production and the manufacturing cost. However, a simply delayed sending of a conventional heat-sensitive transferring medium can not successfully result in good recording since the pressure of the thermal head causes smearing by rubbing.

SUMMARY OF THE INVENTION

It is an object of the present invention to provide a heat-sensitive transferring medium free from the above-mentioned drawbacks.

It is another object of the present invention to provide a heat-sensitive transferring medium which lowers the running cost by a delayed sending for reducing the use amount and moreover, causes no rubbing smearing resulting in formation of sharp transferred images.

According to the present invention, there is provided a heat-sensitive transferring medium of a delayed sending type which comprises a heat-melting ink layer and an overcoating layer mainly composed of a resin and/or a wax and overlying the transferring-side surface of the heat-melting ink layer.

DESCRIPTION OF THE PREFERRED EMBODIMENT

The overcoating layer of the present invention may be composed of a resin, a wax, or a mixture of resin and wax, only. If desired, the overcoating layer may contain additives, for example, lubricants.

The resin or wax forming the overcoating layer preferably melts at 40°-150° C., more preferably at 60°-120° C. The thickness of the overcoating layer is preferably 1-10 μ, more preferably 1-5 μ.

Representative resins forming the overcoating layer are low molecular weight polyethylene, polyvinyl stearate, polystyrene, styrene-butadiene copolymer, acrylic resins, ethylene-vinyl acetate copolymer and the like.

Representative waxes are carnauba wax, ouricury-wax, microcrystalline wax, paraffin wax and the like.

If desired, lublicants such as talc, metal salts of fatty acids, fatty acid amides and the like may be used.

As the heat-melting ink layer of the present invention, there may be used conventional heat-melting ink layers. As a binder material used in the heat-melting ink layer, there may be mentioned waxes such as carnauba wax, ouricury-wax, microcrystalline wax and the like, and easily heat-melting resins such as low molecular weight polyethylene, polyvinyl stearate, polystyrene, styrene-butadiene copolymer, acrylic resins and the like. As a coloring agent used int eh heat-melting ink layer, there may be mentioned dyes and pigments such as alkaline basic dyes, Neozapon dyes, Zapon dyes, carbon black, Lake Red, alkali blue, prussianblue and the like. If desired, a lubricating oil may be added to the ink layer.

The heat-melting ink layer may be produced, for example, by the following procedure. Binders, coloring agents and other components are applied to a substrate of, for example, 2-30 μ thick by a hot-melt coating, or binders, coloring agents and other components are dispersed in a solvent and the resulting liquid coating material is applied to the substrate by a solvent coating. As the substrate, there may be used polyester film, polycarbonate film, triacetyl cellulose film, nylon film, cellophane, glassine paper, condenser paper and the like. Where the substrate is paper, sticking hardly occurs. On the contrary, where the substrate is a plastic film, there is liable to occur, and therefore, it is preferable to form a stick-preventing layer composed of fatty acids, silicone resins or the like on the film.

The product obtained by the above mentioned procedure is a heat-melting ink layer of one-time type.

On the contrary, a multi-type (usable many times) heat-melting ink layer needs a material capable of forming a porous layer. Representative materials capable of forming a porous layer are vinyl resins such as polyvinyl chloride, polyvinyl acetate, plyvinyl fluoride, polyvinyl outyral, polyvinylidene chloride, polyvinyl alcohol, vinyl chloride-vinyl acetate copolymer, vinyl chloride-vinylidene chloride copolymer and the like, acrylic resins such as polyacrylate, polymethacrylate, and the like, cellulose series resins such as ethyl polystyrene, polyethylene, gelatin, gum arabic and the like. These may be used in combination.

According to the present invention, when the multi-type heat-sensitive transferring medium is used, there is not formed any rubbing smearing upon delayed sending of the medium and sharp transferred images can be obtained. In addition, rewinding of the medium is not necessary.

The multi-type heat-sensitive transferring medium can produce much more printing than the one-time type medium.

Resin or wax used in an overcoating layer may be the same as that used as a binder material in the heat-melting ink layer which the overcoating layer overlies.

The practice of the invention is further illustrated with reference to the following non-limiting examples

EXAMPLE 1

A stick-preventing layer composed of sodium stearate was formed on the upper surface of a polyester film of 3 microns thick.

Carnauba wax 30 parts by weight, ester wax 35 parts by weight, carbon black 25 parts by weight, and oil 10 parts by weight were mixed in a heated roll-mill. The resulting heat-melting ink was applied to the under surface of the polyester film to produce a heat-melting ink layer. Then, a coating material composed of carnauba wax 50 parts by weight and ester wax 50 parts by weight was applied to the surface of the heat-melting ink layer to form an overcoating layer.

The resulting heat-sensitive transferring medium was used for printing at a speed of 1/5 times the ordinary ribbon speed (moving rate) by means of a heat-sensitive transferring printer, and sharp printed letters were obtained without rubbing smearing.

On the contrary, the same heat-sensitive transferring medium without the overcoating layer gave poor printed letters with rubbing smearing.

EXAMPLE 2

A stick-preventing layer composed of potassium lauryl phosphate (a mixture of monoester and diester) was formed on the upper surface of a polyester film of 3 microns thick, and an undercoating bonding layer composed of a vinyl chloride-vinyl acetate copolymer and a plasticizer was formed on the under surface of the polyester film. To the surface of the resulting undercoating bonding layer was applied a coating material composed of vinyl chloride-vinyl acetate copolymer 10 parts by weight, stearic acid 13 parts by weight nigrosine 3 parts by weight, carbon black 3 parts by weight, toluene 26 parts by weight, and ethyl acetate 45 parts by weight to produce a porous heat-melting ink layer.

To the surface of the resulting heat-melting ink layer was applied a coating material composed of montan wax 30 parts by weight, cornauba wax 30 parts by weight, and microcrystalline wax 40 parts by weight to form an overcoating layer.

The resulting heat-sensitive transferring medium was used for printing at a speed of 1/10 times the ordinary ribbon speed (moving rate) by means of a heat-sensitive transferring printer, and sharp printed letters were obtained without rubbing smearing.

On the contrary, the same heat-sensitive transferring medium without the overcoating layer gave poor printed letters with rubbing smearing when the same delayed sending as above was employed, though good printed letters were produced when the sending speed ratio of the medium to a receiving paper was 1:1.

What is claimed is:

1. A heat-sensitive transferring medium of a delayed sending type comprising:

(a) a substrate (b) a heat-melting ink layer applied to the surface of said substrate, wherein the applied heat-melting ink layer has a transferring-side surface and (c) an overcoating layer overlying the transferring-side surface of the heat-melting ink layer which comprises one or more compounds selected from the group consisting of polyvinylstearate resin, styrene-butadiene copolymer resin, and ouricury wax, wherein said overcoating layer does not contain a coloring agent.

2. A heat-sensitive transferring medium of a delayed sending type according to claim 1 in which the compound contained in the overcoating layer melts at 40 C°-150° C.

3. A heat-sensitive transferring medium of a delayed sending type according to claim 2 in which the compound melts at 60° C.-120° C.

4. A heat-sensitive transferring medium of a delayed sending type according to claim 1 in which the compound in the overcoating layer is styrene-butadiene copolymer resin.

5. A heat-sensitive transferring medium of a delayed sending type according to claim 1 in which the compound in the overcoating layer is ouricury-wax.

6. A heat-sensitive transferring medium of a delayed sending type according to claim 8 in which the overcoat layer further contains a lubricant.

* * * * *